US006648417B1

(12) United States Patent
Gilbert et al.

(10) Patent No.: US 6,648,417 B1
(45) Date of Patent: Nov. 18, 2003

(54) AUXILIARY FOOTREST FOR CHAIR

(75) Inventors: Richard R. Gilbert, S. Barrington, IL (US); Ed Y. Wu, Willowbrook, IL (US); Tom Chmiel, Elmhurst, IL (US); John M. Jepsen, Grayslake, IL (US)

(73) Assignee: Iceberg Enterprises, LLC, Glendale Heights, IL (US)

( * ) Notice: Subject to any disclaimer, the term of this patent is extended or adjusted under 35 U.S.C. 154(b) by 0 days.

(21) Appl. No.: 09/880,569

(22) Filed: Jun. 13, 2001

(51) Int. Cl.[7] ..... A47C 7/50

(52) U.S. Cl. ..... 297/423.25; 297/423.19; 297/423.2; 297/423.4

(58) Field of Search ..... 297/423.19, 423.2, 297/423.25, 423.4

(56) References Cited

U.S. PATENT DOCUMENTS

| | | | | | |
|---|---|---|---|---|---|
| 388,981 | A | | 9/1888 | La Barbe | |
| 586,295 | A | | 7/1897 | Terry | |
| 595,450 | A | * | 12/1897 | Archer | 297/423.19 |
| 611,327 | A | * | 9/1898 | Kelly | 297/423.37 |
| D78,016 | S | | 3/1929 | Goble | |
| 2,546,460 | A | * | 3/1951 | Leeds | 248/122.1 |
| 2,850,077 | A | | 9/1958 | Dawson | |
| 3,902,737 | A | | 9/1975 | Berger et al. | |
| 4,148,524 | A | | 4/1979 | Guyton | |
| 4,767,160 | A | * | 8/1988 | Mengshoel et al. | 297/423.12 |
| 4,793,655 | A | * | 12/1988 | Kvalheim et al. | 297/423.13 |
| 4,915,450 | A | * | 4/1990 | Cooper | 297/423.35 |
| 4,960,305 | A | * | 10/1990 | Opsvik | 297/423.12 |
| 5,011,227 | A | * | 4/1991 | van Hekken et al. | 297/423.26 |
| 5,044,633 | A | * | 9/1991 | Rice | 482/138 |
| 5,060,896 | A | | 10/1991 | Hobbins | |
| 5,174,631 | A | * | 12/1992 | Schaevitz | 297/423.19 |
| D336,791 | S | | 6/1993 | Stidd | |
| 5,255,957 | A | * | 10/1993 | Opsvik et al. | 297/423.12 |
| 5,547,253 | A | | 8/1996 | Schwartz et al. | |
| 5,782,532 | A | * | 7/1998 | Opsvik | 297/338 |
| 5,816,556 | A | | 10/1998 | Liao | |
| 5,867,132 | A | | 2/1999 | Blasing et al. | |
| 5,921,629 | A | | 7/1999 | Koch et al. | |
| 5,957,419 | A | * | 9/1999 | Lancaster et al. | 248/188.1 |
| 6,142,571 | A | | 11/2000 | Benden | |
| 6,149,239 | A | | 11/2000 | Markussen et al. | |

FOREIGN PATENT DOCUMENTS

| | | | |
|---|---|---|---|
| DE | 2701573 A1 | * | 7/1978 |
| JP | 09285361 | * | 11/1997 |

* cited by examiner

*Primary Examiner*—Peter R. Brown
*Assistant Examiner*—Joseph Edell
(74) *Attorney, Agent, or Firm*—Leydig, Voit & Mayer, Ltd.

(57) ABSTRACT

An auxiliary footrest for removably mounting to a chair having a post is disclosed. The footrest includes a clamp configured to be removably mounted to the post of the chair and generally C-shaped frame fixed to the clamp. The frame includes a foot support bar and opposite ends which define respective mounting rods for mounting the frame to clamp. The clamp includes a first bracket and a second bracket, each of which may be generally W shaped. Each of the brackets is mounted between the respective mounting rods of the frame, receiving the post between opposed V-shaped wall sections of the brackets. The brackets are secured to exert a squeezing force against generally opposite sides of the post, thereby fixing the footrest to the chair so that the foot support bar is cantilevered forwardly and elevated above the floor. The user can install and/or adjust the footrest at a desired vertical level for custom comfort. Additionally, the frame may be secured to the clamp in a variety of horizontal positions to permit adjustment of the foot support bar to a desired horizontal distance from the post.

7 Claims, 10 Drawing Sheets

AUXILIARY FOOTREST FOR CHAIR

FIELD OF THE INVENTION

The present invention relates generally to a footrest for a chair and more particularly to a removable and adjustable auxiliary footrest for a chair.

BACKGROUND OF THE INVENTION

A common type of office chair generally includes a base having casters to support the chair on the floor, a post extending upwardly from the base and a seat mounted on top of the post. For added comfort, it is known to provide a footrest to support the feet of a seated user. One known type of footrest is a stool, separate from the chair, which may be placed on the floor in front of a chair. Additionally, some structures are known to provide a footrest integral to the chair. Chairs which include such a footrest are shown in, for example, U.S. Pat. No. 6,149,239 and 6,142,571.

While previously known footrests for chairs provide certain advantages, there remain certain problems with these footrests. For example, the footrest stool must be separately repositioned whenever the user moves the chair. During the course of a single workday, a user may need to move his chair several times, requiring the inconvenient movement of the stool. With respect to the integral footrest, such previous footrests have not previously been readily adjustable to allow the footrest to accommodate users of varying size. Additionally, the mounting structures of these footrests often loosen with use. The inconvenience of re-attaching the footrest to the chair often dissuades the user from re-attaching the footrest after it has become loosened.

In view of the foregoing, a need exists for an improved footrest. A particular need exists for an auxiliary footrest which can be easily and reliably attached to a chair. A further need exists for a simple means by which the footrest can be adjusted. An additional need is for a footrest that can be adjusted in various ways to accommodate various users of the chair and to increase the ergonomic effect of the footrest.

SUMMARY OF THE INVENTION

The present invention addresses the foregoing and other needs by providing an adjustable footrest that is removably mountable to a chair having a base with a generally vertical post.

In an exemplary embodiment, a footrest is provided for removable and adjustable installation on a post of a chair. The footrest includes a clamp which is compressible around the post and a frame having a foot support bar. The frame is mounted to the clamp to project from the post in a cantilevered manner, holding the foot support bar in an elevated position with respect to the floor.

In an embodiment, the frame is generally C-shaped, the frame including opposite end portions which define first and second mounting rods for mounting the frame to the clamp, the mounting rods being proximal and generally parallel to each other, the frame including an intermediate portion defining a foot support bar which extends in a generally curved manner between the first and second mounting rods. To firmly mount the footrest, the clamp may include two cooperating halves, such as first and second brackets configured to receive the post securely therebetween. Each of the brackets is mountable between the respective first and second mounting rods of the frame. In one disclosed structure, each of the brackets includes a substantially V-shaped wall portion, the first and second brackets being positioned so that the respective V-shaped wall portions oppose each other to define an aperture to receive the post. The brackets are mounted tightly so the V-shaped wall portions squeeze against opposite sides of the post. Each of these brackets may, in an embodiment, be generally W-shaped, having a pair of planar mounting flanges at opposite ends of the respective bracket. The flanges are securable against inner sides of the respective first and second mounting rods.

In order to tightly secure the brackets, the structure may include a plurality of bolts. Each of the bolts extends through a pair of associated bolt holes in the first and second mounting rods. For providing horizontal adjustability of the footrest, each of the mounting rods includes a plurality of bolt holes disposed in a horizontal row. Additionally, each of the bolt holes is generally slot-shaped to permit horizontal adjustment of the bolt within the respective hole. Moreover, each of the bolts also extends through bolt holes in each of the opposite mounting flanges of a respective one of the brackets, thereby tightening the respective mounting rods to compress inwardly against the brackets. To provide vertical adjustability, each of the flanges includes a plurality of bolt holes disposed in a vertical row.

An advantage of the present invention is that it provides a footrest which may be retrofit as an auxiliary feature.

Another advantage of the present invention is that it provides a footrest which yields ergonomically-pleasing foot support.

A further advantage of the present invention is that it provides a footrest having a simple structure that securely mounts the footrest to the chair.

Yet another advantage of the present invention is that it provides a footrest which is adjustable.

These and other objects and advantages, as well as additional inventive features, of the present invention will become apparent to one of ordinary skill in the art upon reading the detailed description, in conjunction with the accompanying drawings, provided herein.

DETAILED DESCRIPTION OF EMBODIMENTS OF THE INVENTION

Figure 1:
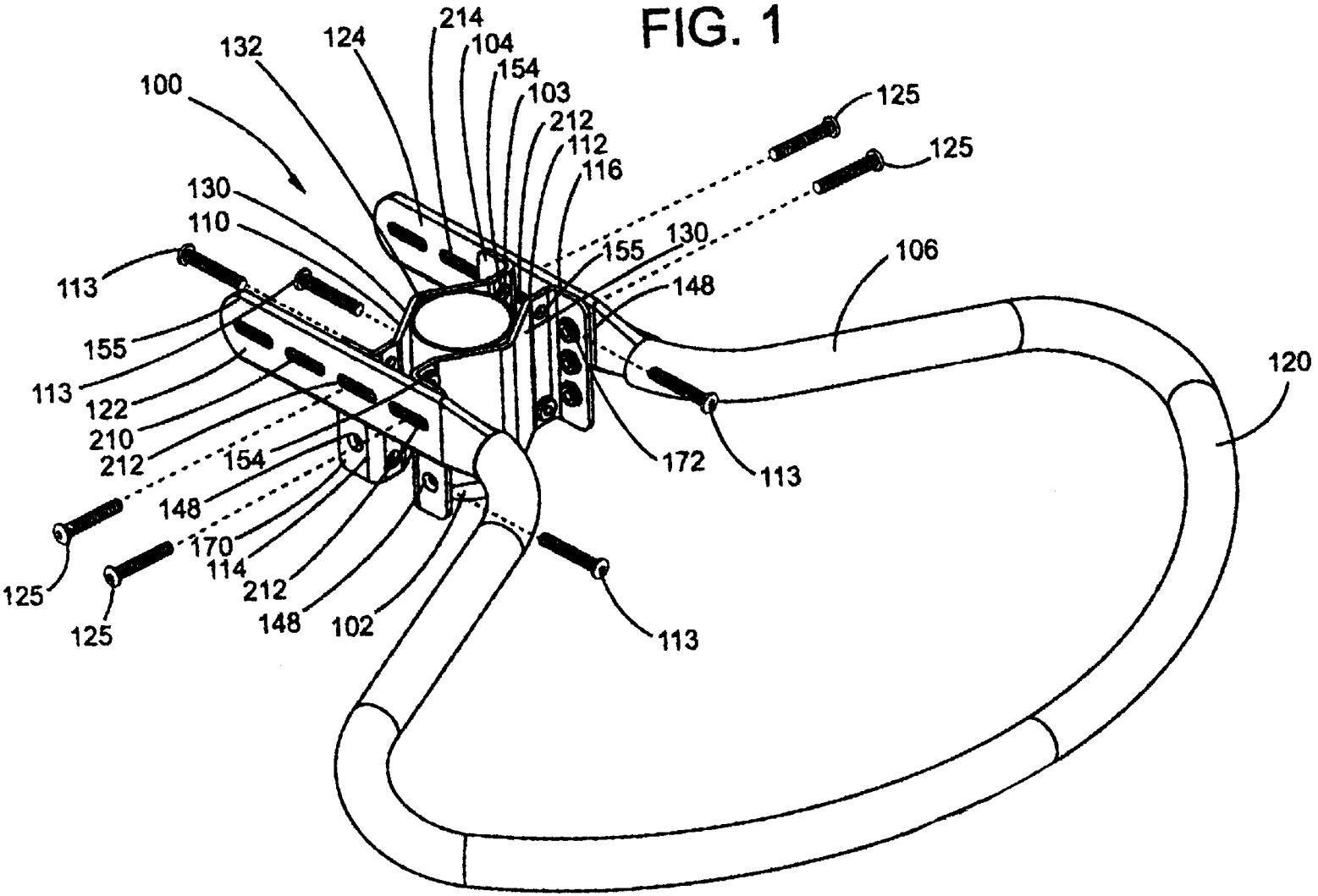
FIG. 1 is a perspective view of a footrest adjustably mounted onto a chair in accordance with a preferred embodiment of the present invention.

Turning now to the FIG., there is shown in FIG. 1 an illustrative footrest 100 mounted to a chair 102 having a post 103. For illustrative purposes, only a portion of the post 103 of the chair 102 is shown. The chair 102 can be a standard office chair, which includes the post, a base depending from the post with the base having a plurality of legs and depending casters, a seat supported by the post, and a backrest. The chair 102 is representative of the type of chair with which the footrest 100 is compatible. The footrest 100 is adaptable to be used with other types of chairs having a post.

The footrest 100 includes a clamp 104 and a frame 106. The clamp 104 is configured to be removably mounted to the post 103 of the chair 102. The clamp 104 includes a first bracket 110 and a second bracket 112. The brackets 110, 112 can be attached to each other by bolts 113 or other fastening techniques, for example, to mount the clamp 104 to the post 103. The clamp 104 can be fixed in position relative to the post 103. The clamp 104 has a first side 114 and a second side 116. The frame 106 can be adjustably mounted to the clamp 104 such that the position of the frame 106 relative to the post 103 of the chair 102 can be moved both horizontally and vertically. The frame 106 includes a foot support bar 120, a first mounting rod 122, and a second mounting rod 124. The first and second mounting rods 122, 124 of the frame 106 can be mounted over a range of positions to the first and second sides 114, 116, respectively, of the clamp 104 by bolts 125 or other fastening techniques, for example, to assemble the footrest 100. The frame 106 can be adjustably mounted to the clamp 104 in a cantilevered fashion such that the foot support bar 120 is in an elevated position relative to the floor.

The clamp 104 in conjunction with the mounting rods 122, 124 of the frame 106 act as means for removably mounting the footrest 100 to the post 103 of the chair 102 such that the means for supporting a foot, i.e., the foot support bar 120., extends from the chair 102 in an elevated position. The brackets 110, 112 of the clamp 104 are identical to each other. Accordingly the description of the first bracket 110 is applicable to the second bracket 112, and vice versa.

Each bracket 110, 112 is generally W-shaped. Each bracket 110, 112 includes a substantially V-shaped wall portion 130. The brackets 110, 112 can be mounted together such that the V-shaped wall portions 130 cooperate to define an aperture 132 to accommodate the post 103 therethrough. The respective V-shaped wall portions 130 oppose each other to define the aperture 132. The brackets 110, 112 are configured to receive the post securely therebetween. The V-shaped wall portions 130 squeeze against generally opposite sides of the post 103 to mount the clamp 104 to the post 103. It will be understood that the size of the aperture 132 can be varied to accommodate posts of different sizes.

Figure 2:
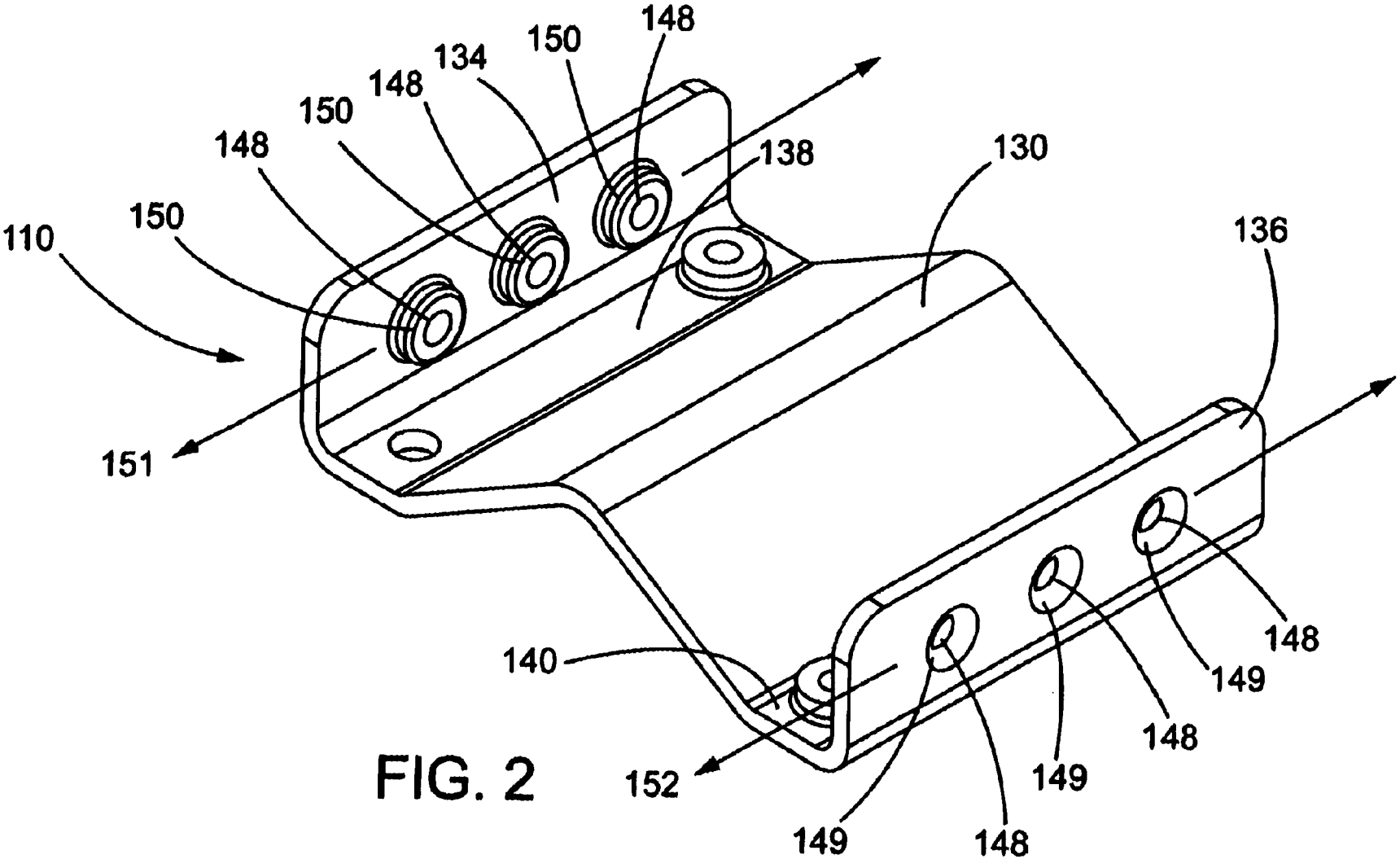
FIG. 2 is a perspective view of a bracket.

Referring to FIG. 2, the first bracket 110 includes a first mounting flange 134, a second mounting flange 136 and a pair of mounting portions 138, 140. The mounting flanges 134, 136 are disposed at opposite ends of the first bracket 110. The mounting portions 138, 140 are disposed adjacent to the first and second mounting flanges 134, 136, respectively. The substantially V-shaped wall portion 130 is disposed between the mounting portions 138, 140. For providing vertical adjustability of the footrest, each of flanges 134, 136 includes a column of adjustment holes 148. The illustrative bracket 110 includes three adjustment holes 148 disposed on both the first mounting flange 134 and the second mounting flange 136. The adjustment holes 148 are identical to each other. Each adjustment hole 148 includes a countersink 149 and a threaded portion 150. The countersink 149 facilitates the mounting of the frame to the bracket 110 of the clamp by providing a guide surface for the bolt, or other type of fastener, used to mount the frame. The countersink 149 guides the bolt to align it with the adjustment hole 148. The threaded portion 150 can threadingly engage a bolt to mount the frame to the bracket 110. In other embodiments, the adjustment hole can have different configurations. For example, the countersink 149 and/or the threaded portion 150 can be omitted.

The mounting flanges 134, 136 are substantially planar. On each mounting flange 134, 136, the adjustment holes 148 are disposed in spaced relation to each other along a respective longitudinal axis 151, 152 of the mounting flanges 134, 136. When the footrest is mounted to a chair, the longitudinal axes 151, 152 of the mounting flanges 134, 136 are substantially vertical. In other embodiments, the number and location of adjustment holes 148 for each flange can be varied. In yet other embodiments, the number of adjustment holes can vary between the flanges. For example, in another embodiment the first flange can have no adjustment holes whatsoever. In other embodiments the first or the second flange can be omitted. In other embodiments the size of the mounting flanges 134, 136 can be varied.

Figure 3:
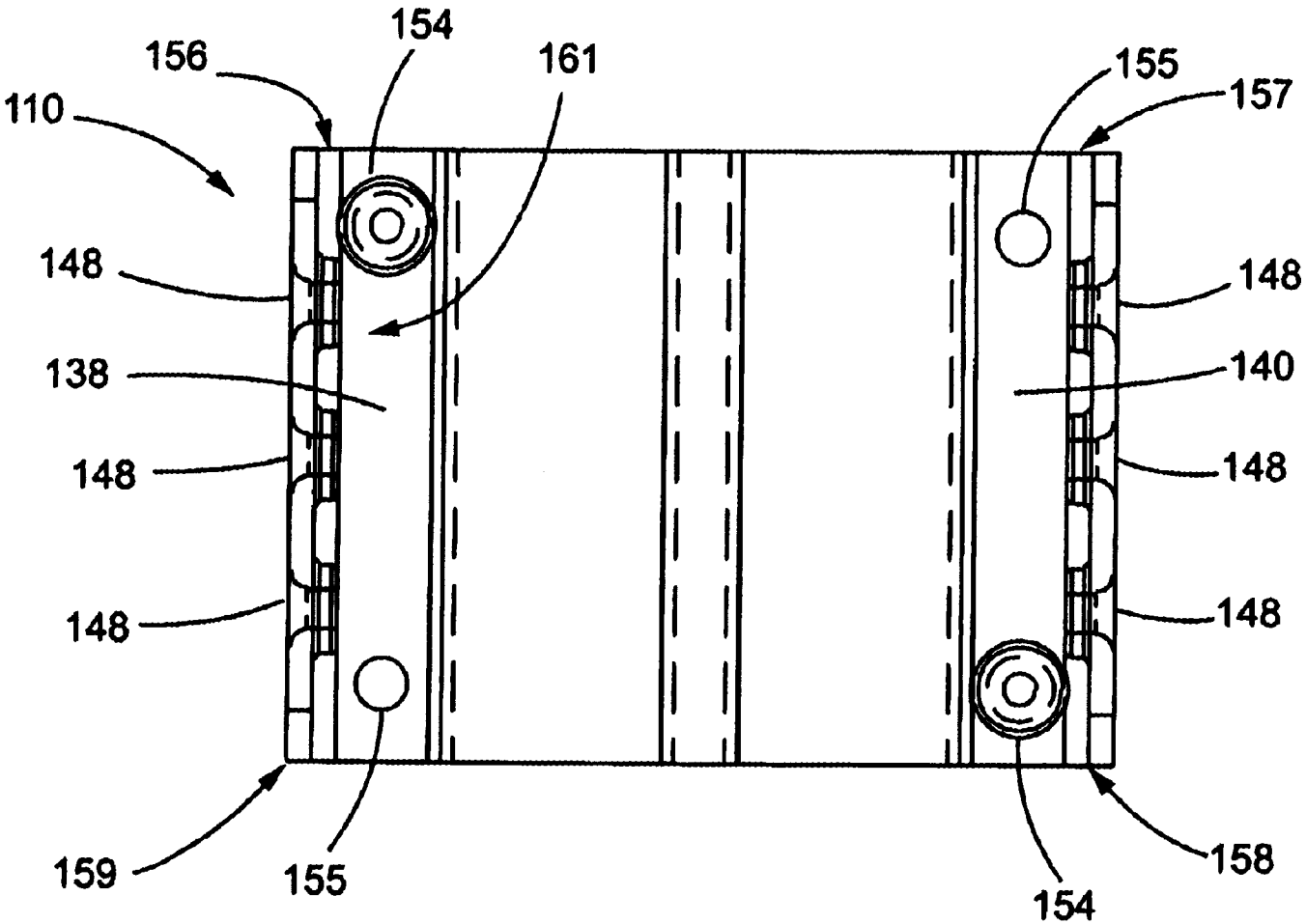
FIG. 3 is a plan view of the bracket in FIG. 2.

Referring to FIG. 3, each mounting portion 138, 140 of the first bracket 110 includes first and second mounting holes 154, 155. The first mounting holes 154 are disposed in diagonally-opposing comers 156, 158 of the bracket 110. The second mounting holes 155 are disposed in diagonally-opposing comers 157, 159 of the bracket 110. The first and second mounting holes 154, 155 are disposed in spaced relation to each other such that when the first bracket 110 and the second bracket are mated together to define the aperture, the first mounting holes 154 of the first bracket 110 are aligned with the second mating holes of the second bracket and the second mounting holes 155 of the first bracket 110 are aligned with the first mating holes of the second bracket. The mounting holes 154, 156 are positioned such that a bolt or other fastener extending through the mounting hole 154, 155 will not interfere with another bolt or other fastener extending through any of the adjustment holes 148. In other embodiments, the number and location of the first and second mounting holes 154, 155 can be varied.

The second mounting holes 155 are identical to each other. Each second mounting hole 155 is a through hole. To mount the first bracket 110 to the second bracket, a bolt is inserted through the second mounting hole 155 such that the head of the bolt is adjacent an outer surface 161 of the first bracket 110.

Figure 4:
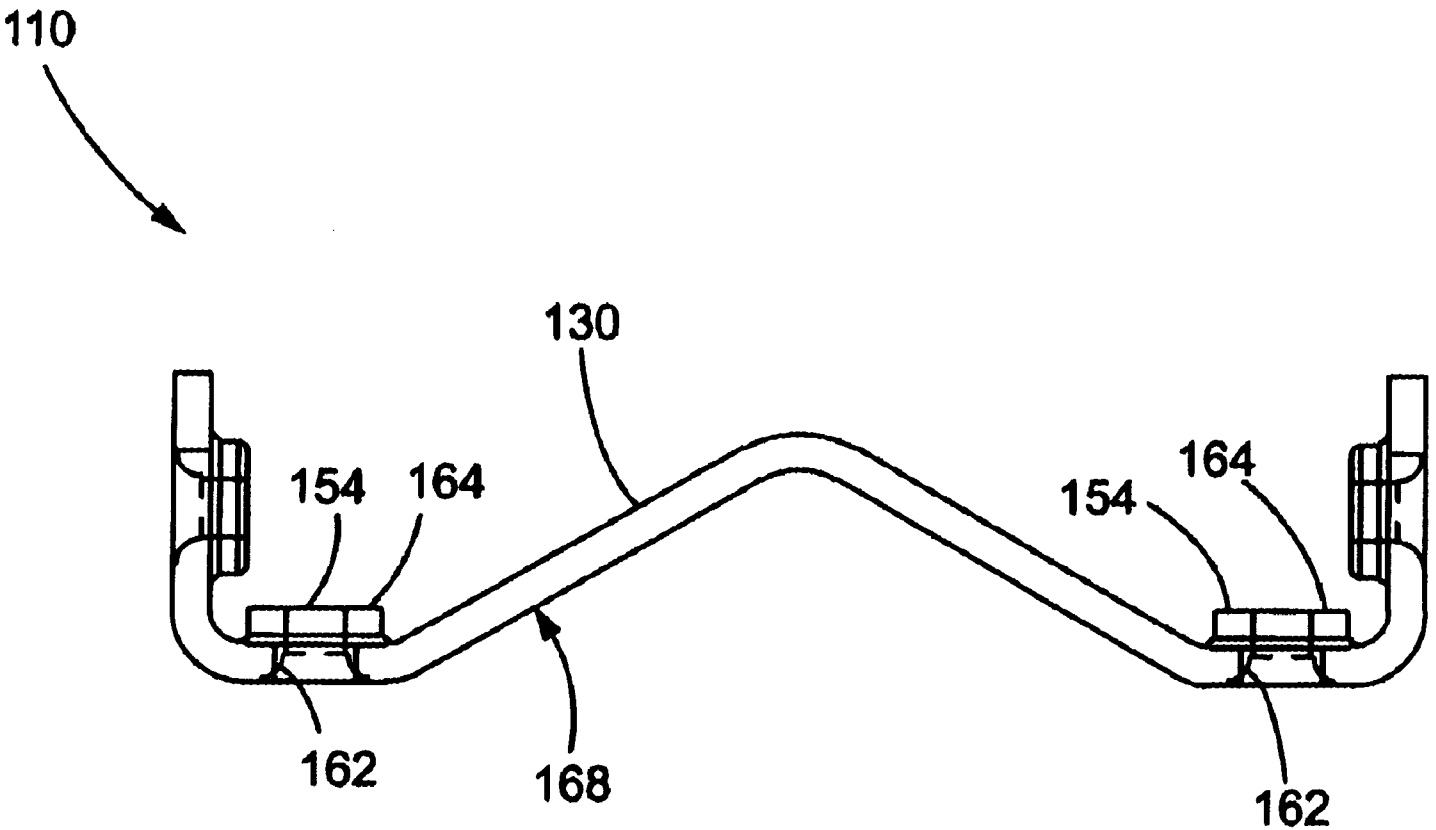
FIG. 4 is a end elevational view of the bracket in FIG. 2.

Referring to FIG. 4, the first mounting holes 154 of the first bracket 110 are identical to each other. Each mounting hole 154 includes a countersink 162 and a threaded portion 164. The countersink 162 facilitates the mounting of the first bracket 110 to the second bracket by providing a guide surface for the bolt, or other type of fastener, used to mount the brackets to the post of the chair. The countersink 162 guides the bolt to align it with the first mounting hole 154. The threaded portion 164 can threadingly engage a bolt to mount the first bracket to the to the second bracket. In other embodiments, the adjustment hole can have different configurations. For example, the countersink 149 and/or the threaded portion 150 can be omitted.

The substantially V-shaped wall portion 130 of the first bracket 110 includes a mating surface 168 for engaging the post of the chair. To facilitate mounting and to avoid conformity problems between the bracket 110 and the post, the mating surface 168 is configured such that it contacts the post at two points along the outer surface of the post.

Figure 5:
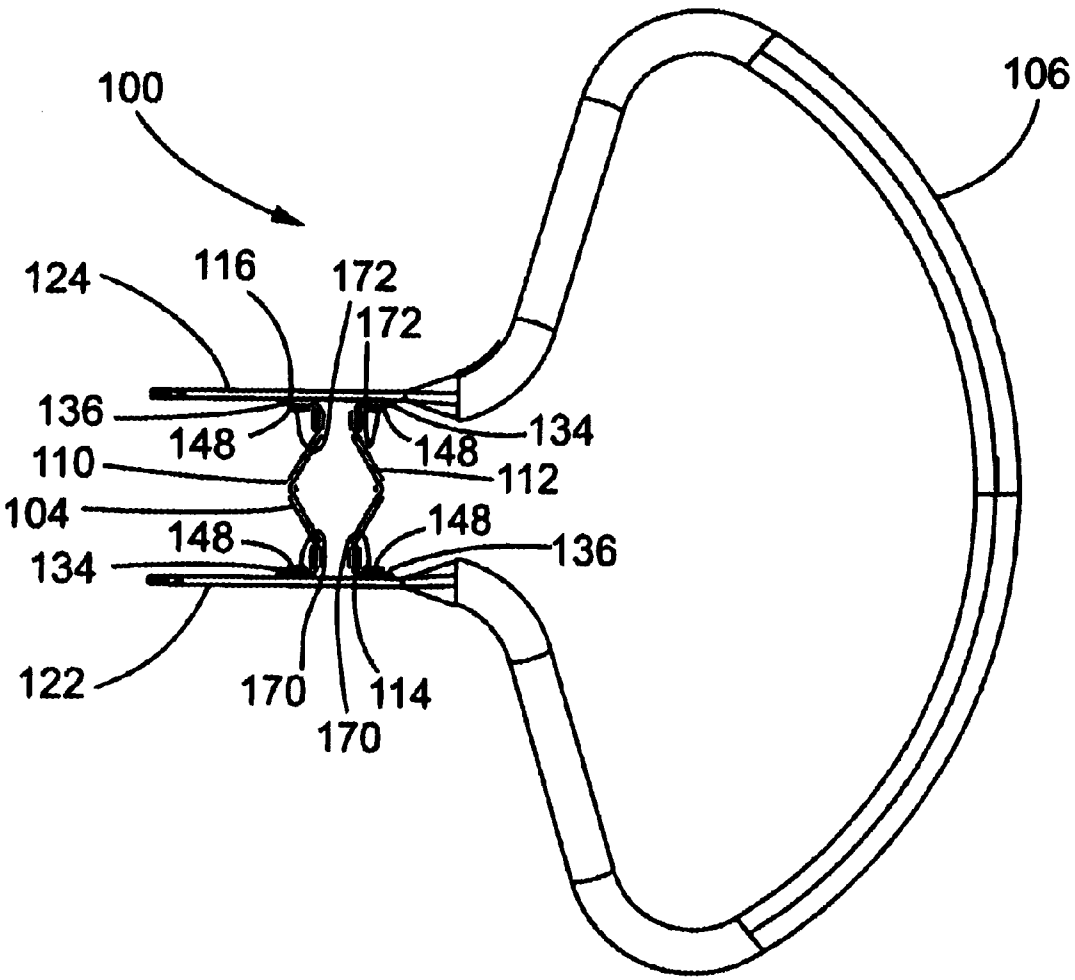
FIG. 5 is a plan view of the footrest in FIG. 1.

Referring to FIG. 5, the frame 106 is mounted to the clamp 104. The first and second brackets 110, 112 are configured to receive the post securely therebetween. The first and second brackets 110, 112 are disposed between the first and second mounting rods 122, 124. The first mounting flange 134 of the first bracket 110 and the second mounting flange 136 of the second bracket 112 define the first side 114 of the clamp 104. The first mounting flange 134 of the second bracket 112 and the second mounting flange 136 of the first bracket 110 define the second side 116 of the clamp 104. In the illustrative embodiment, the clamp 104 includes a first plurality 170 of adjustment holes 148 located on the first side 114 and a second plurality 172 of adjustment holes 148 located on the second side 116. The first plurality 170 includes the adjustment holes 148 located on the first mounting flange 134 of the first bracket 110 and on the second mounting flange 136 of the second bracket 112. The second plurality 172 includes the adjustment holes 148 located on the second mounting flange 136 of the first bracket 110 and on the first mounting flange 134 of the second bracket 112.

Figure 6:
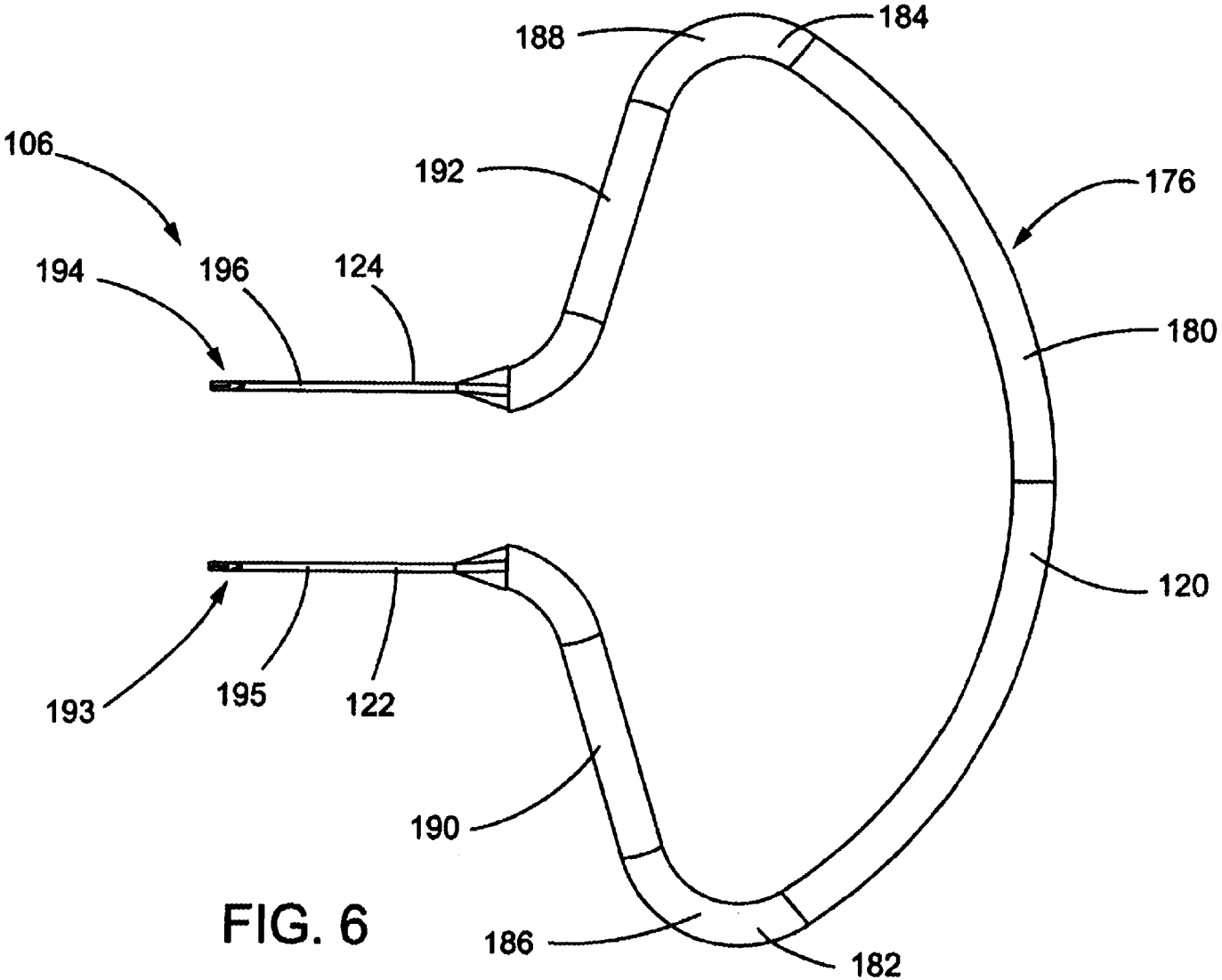
FIG. 6 is a plan view of a frame.

Referring to FIG. 6, the frame 106 is a unitary member. The frame 106 is generally C-shaped. The frame 106 includes an intermediate portion 176 which defines the foot support bar 120. The foot support bar 120 extends in a generally curved manner between the first and second mounting rods 122, 124. The foot support bar 120 of the frame acts as a means for supporting a foot and includes a curved segment 180 having a pair of ends 182, 184. A pair of corner segments 186, 188 are adjacent the respective ends 182, 184 of the curved segment 180. A pair of tapered segments 190, 192 are adjacent the respective comer segments 186, 188. The tapered segments 190, 192 are in respective association with the first and second mounting rods 122, 124. The foot support bar 120 of the frame is made of metal tubing.

The frame includes opposite end portions 193, 194 which define the first and second mounting rods 122, 124. The mounting rods 122, 124 are proximal and generally parallel to each other. The first and second mounting rods 122, 124 of the frame include substantially planar metal sections 194, 196, respectively.

Figure 7:
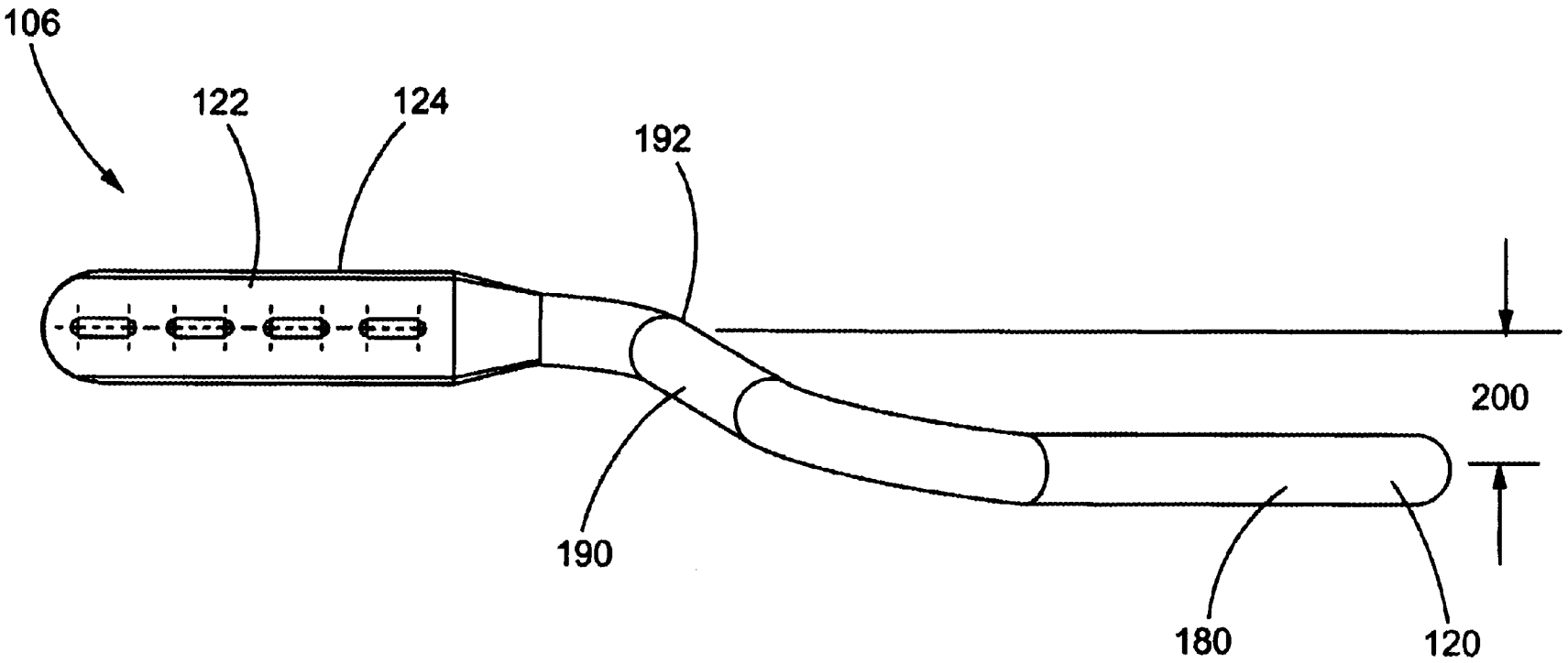
FIG. 7 is a side elevational view of the frame in FIG. 6.
Figure 8:
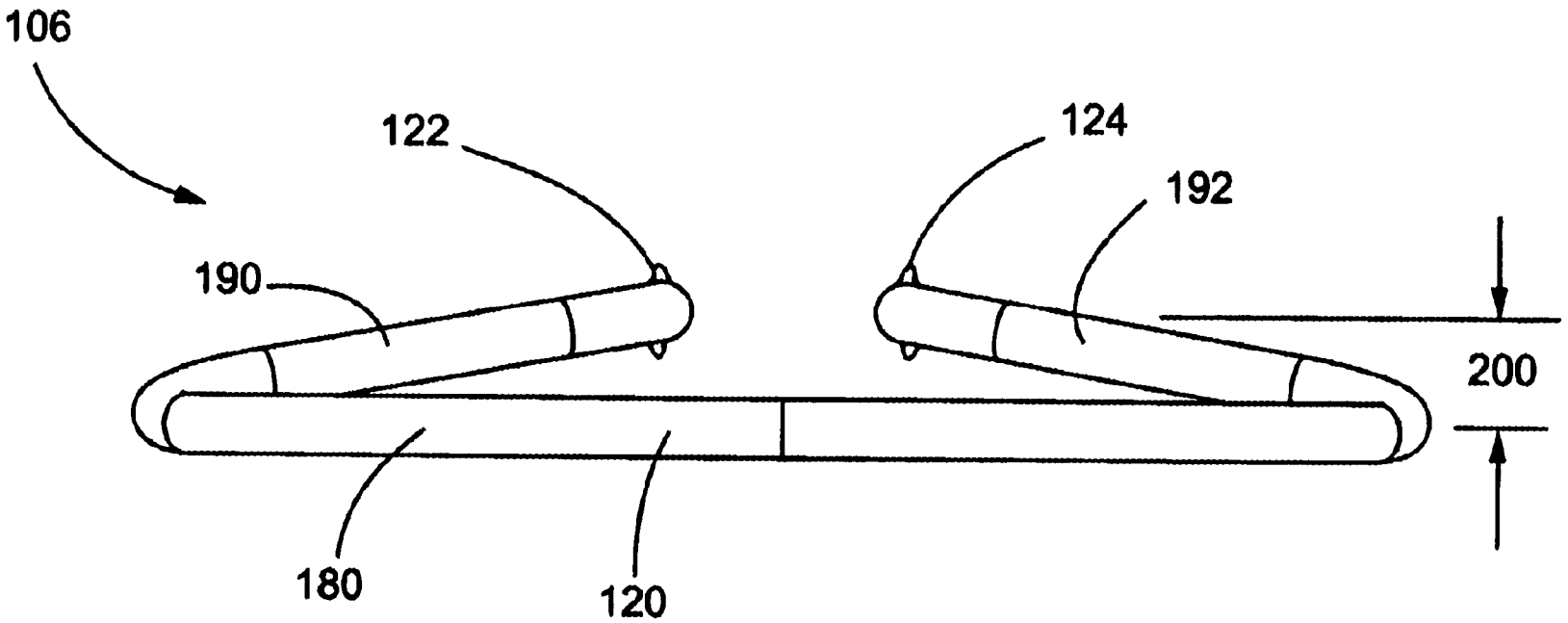
FIG. 8 is an end elevational view of the frame in FIG. 6.

Referring to FIGS. 7 and 8, the tapered segments 190, 192 of the frame 106 are disposed obliquely to the mounting rods 122. 124 and the curved segment 180 of the foot support bar 120 such that the curved segment 180 is offset a selected distance 200 from the mounting rods 122, 124.

Figure 9:
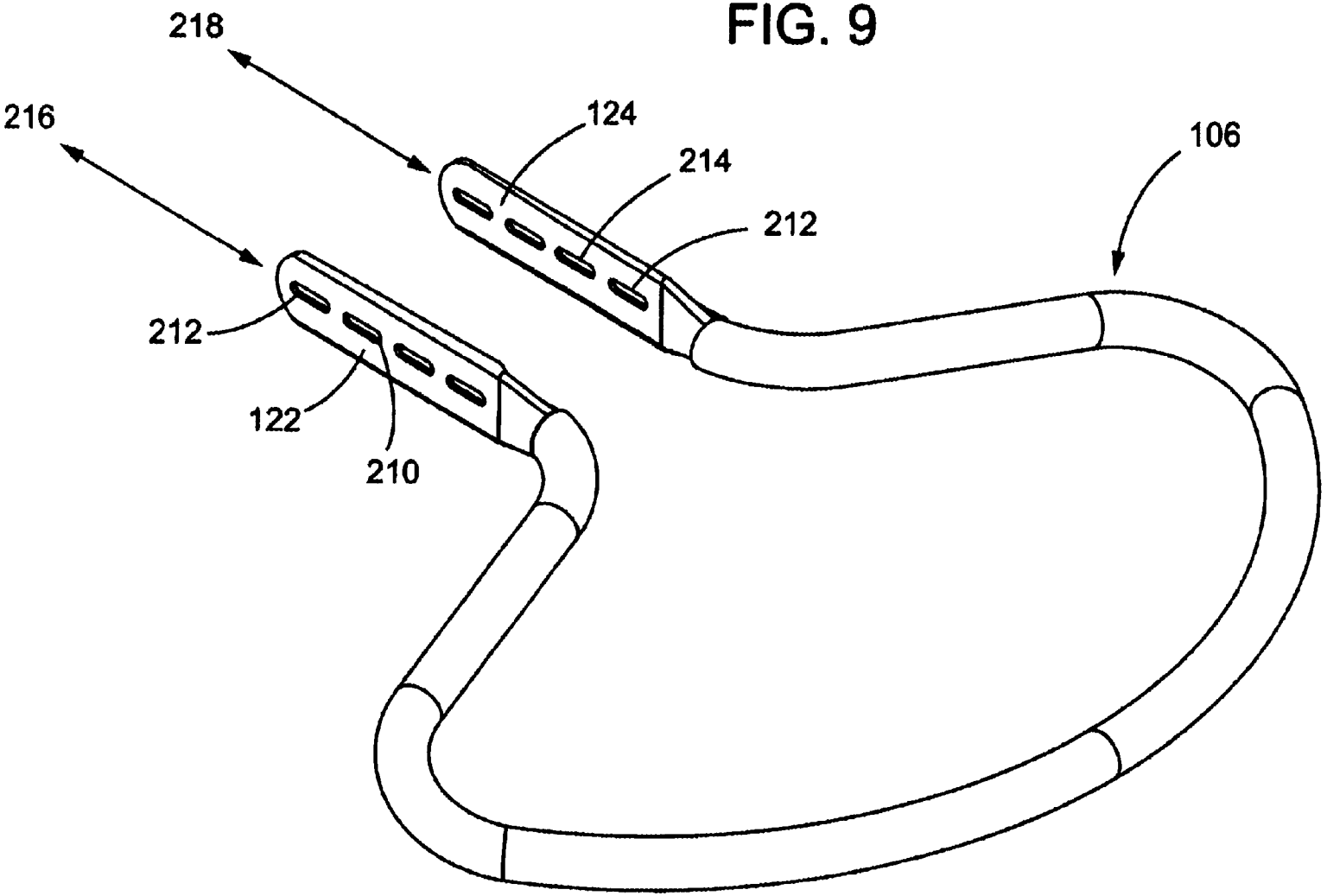
FIG. 9 is a perspective view of the frame in FIG. 6.

Referring to FIG. 9, for providing horizontal adjustability of the footrest, each of the mounting rods 122, 124 of the frame 106 includes a row of adjustment holes 212. The frame 106 includes a third plurality 210 of adjustment holes 212 located on the first mounting rod 122 and a fourth plurality 214 of adjustment holes 212 located on the second mounting rod 124. The adjustment holes 212 are identical to each other. Each adjustment hole 212 is in the form of an elongated slot. The adjustment holes 212 are disposed in spaced relation to each other along a respective longitudinal axis 216, 218 of the mounting rods 122, 124 to define a respective row. When the footrest is mounted to a chair, the longitudinal axes 216, 218 of the mounting rods 122, 124 are substantially horizontal. In other embodiments, the number, location, and size of the adjustment holes 212 for each mounting rod can be varied. For example, in other embodiments, the plurality of adjustment holes can be replaced with one enlarged slot. In yet other embodiments, the number of adjustment holes 212 can vary between the mounting rods. For example, in another embodiment the first mounting rod can have no adjustment holes whatsoever. In other embodiments the first or the second mounting rod can be omitted.

Figure 10:
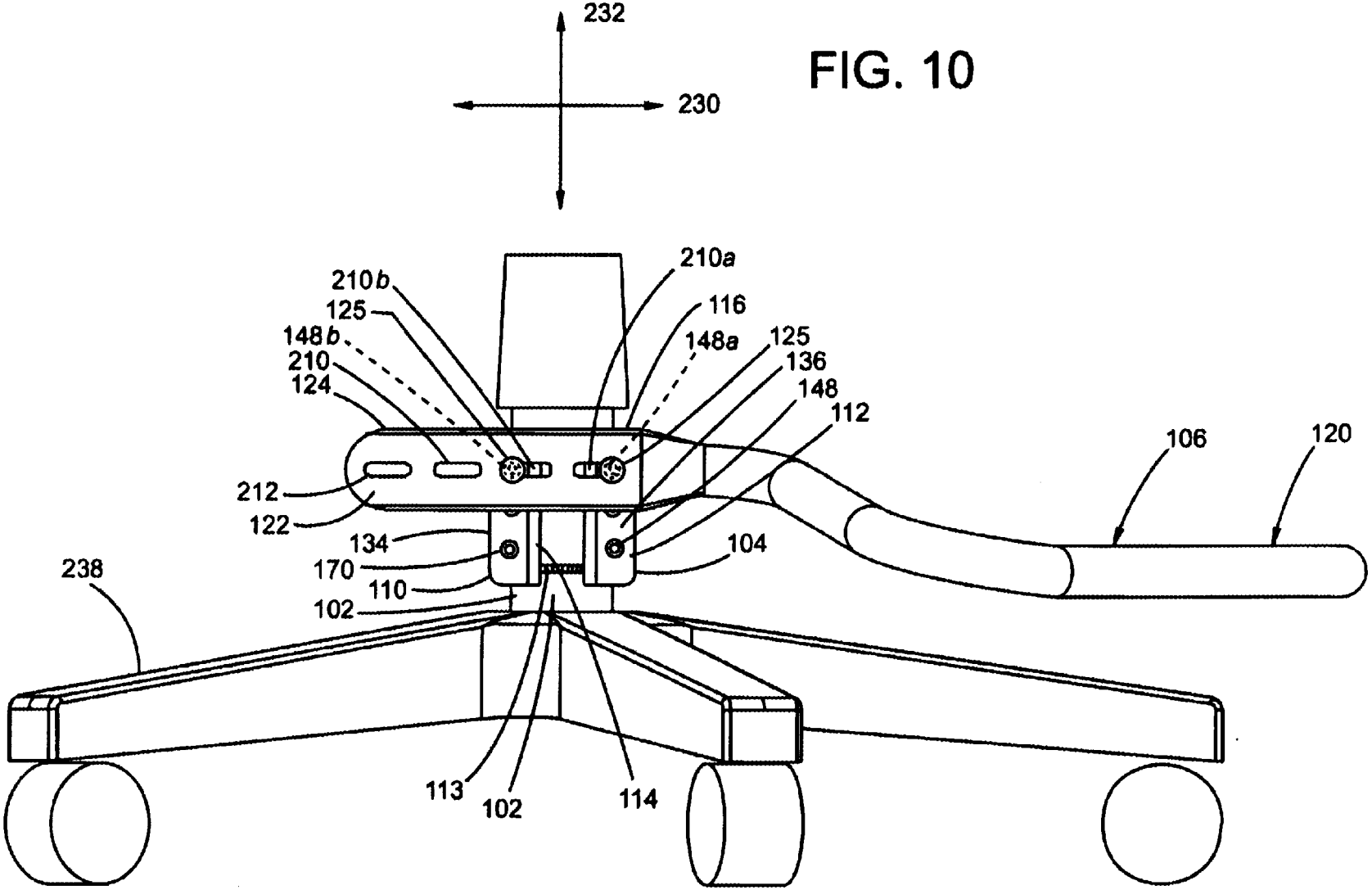
FIG. 10 is a side elevational view of the footrest in FIG. 1 shown adjustably mounted to the chair.

Referring to FIG. 10, the clamp 104 is removably mounted to the post 103 of the chair 102 by the bolts 113. The first mounting rod 122 of the frame 106 is mounted to the first mounting flange 134 of the first bracket 110 and to the second mounting flange 136 of the second bracket 112, i.e., the first side 114 of the clamp 104, by the bolts 125. The second mounting rod 124 of the frame 106 is mounted to the second flange of the first bracket 110 and the first flange of the second bracket 112, i.e., the second side 116 of the clamp 104, by the bolts. The first and second mounting rods 122, 124 compress inwardly against, respectively, the first and second sides 114, 116 of the clamp 104 to mount the frame 106 to the clamp 104.

The frame 106 is adjustably mounted to the clamp 104 in a cantilevered manner such that the foot support bar 120 is in an elevated position. The foot support bar 120 extends from the mounting rods 122, 124 and is unsupported by any other structure.

The first plurality 170 of adjustment holes 148 of the clamp 104 and the third plurality 210 of adjustment holes 212 of the frame 106 cooperate together to allow for adjustment of the frame 106 relative to the clamp 104 and the chair 102 along a horizontal axis 230 and a vertical axis 232. The horizontal axis 230 and the vertical axis 232 are perpendicular to each other. The second plurality of holes of the clamp 104 and the fourth plurality of holes of the frame 106 cooperate together in a similar manner as the first and third pluralities 170, 210 to allow for adjustment of the frame 106 along the horizontal axis 230 and the vertical axis 232. The first and second pluralities of adjustment holes 148 and the third and fourth pluralities of adjustment holes 210 act as means for adjusting the vertical and horizontal position of the means for supporting a foot, which in this embodiment is the foot support bar 120.

It will be understood that the following description relating to the first plurality 170 and the third plurality 210 is also applicable to the second and fourth pluralities. The frame 106 can be located at any of a range of horizontal and vertical positions by aligning selected mounting holes 212 of the third plurality 210 of the frame with selected mounting holes 148 of the first plurality 170 of the clamp 104. For example, in FIG. 10, the frame 106 is mounted to the clamp 104 by aligning the adjustment holes 210*a*, 210*b* of the frame 106 that are closest to the foot support bar 120 with, respectively, the adjustment holes 148*a*, 148*b* of the clamp 104 that are furthest from the base 238 of the chair 102. Bolts 125 or other fasteners can be used to mount the frame 106 to the clamp 104 at the selected position. The position of the frame 106 can be adjusted relative to the clamp 104 by detaching the frame 106 from the clamp 104 and re-positioning the frame 106 relative to the clamp 104 at a new position by aligning the adjustment holes that correspond to the newly selected position.

Referring to FIG. 1, to use the footrest 100 with the chair 102, the clamp 104 is mounted to the post 103 of the chair 102. The brackets 110, 112 are placed on opposing sides of the post 103. The brackets 110, 112 are mounted to each other by aligning the first and second mounting holes 154, 155 of the first bracket 110 to, respectively, the second and first mounting holes 155, 154 of the second bracket 112. Bolts 113 or other fasteners can be used to mount the brackets 110, 112 to each other such that the clamp 104 is mounted to the post 103. The clamp 104 can be mounted to the post 103 such that the clamp 104 is fixed in position relative to the post 103. The mounting rods 122, 124 of the frame 106 are mounted, respectively, to the first and second sides 114, 116 of the clamp 104 at a desired position relative to the clamp 104 and the post 103. Mounting at the selected position is accomplished by aligning the corresponding adjustment holes 212 of the third and fourth pluralities 210, 214 of the frame 106 respectively with the respective adjustment holes 148 of the first and second pluralities 170, 172 of the clamp 104. Bolts 125 or other fasteners can be used to mount the frame 106 to the clamp 104.

The footrest 100 can be adjusted to any of a range of vertical and horizontal positions by detaching the frame 106 from the clamp 104. The frame 106 can be re-positioned positioned relative to the clamp 104 and the post 103, either horizontally, vertically, or both horizontally and vertically, to another selected position. The frame 106 can be mounted to the clamp 104 as described above at the newly selected position.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode presently known to the inventors for carrying out the invention. Of course, variations of those preferred embodiments would become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A footrest for removably mounting to a chair having a post, the footrest comprising:

a clamp, the clamp configured to be removably mounted to the post of the chair, the clamp includes a first bracket and a second bracket, the brackets being configured to receive the post securely therebetween, each of the brackets includes a substantially V-shaped wall portion, the first and second brackets being positioned so that the respective V-shaped wall portions oppose each other to define an aperture to receive the post, the V-shaped wall portions squeezing against generally opposite sides of the post; and a frame including a foot support bar, the frame being adjustably mounted to the clamp in a cantilevered manner such that the foot support bar is positioned in an elevated manner relative to the floor, the frame being horizontally movable relative to the clamp, the frame being generally C-shaped, the frame including opposite end portions which define first and second mounting rods for mounting the frame to the clamp, the mounting rods being proximal and generally parallel to each other, the frame including an intermediate portion defining the foot support bar which extends in a generally curved manner between the first and second mounting rods;

a plurality of bolts, each of the bolts extending through a pair of associated holes in the first and second mounting rods;

wherein each bracket of the clamp is mountable between the first and second mounting rods of the frame, each bracket has a pair of substantially planar mounting flanges, the flanges being at opposite ends of the respective bracket, the opposite flanges of each bracket being securable to the respective first and second mounting rods such that each of the bolts extends through holes in each of the opposite mounting flanges of a respective one of the brackets, the mounting rods respectively compressing inwardly against the brackets.

2. The footrest of claim 1, wherein each of the brackets is generally W-shaped.

3. The footrest of claim 1, wherein each of the mounting rods includes a plurality of holes disposed in a horizontal row for horizontal adjustability of the footrest.

4. The footrest of claim 3, wherein each of the holes of the mounting rods comprises a slot to permit horizontal adjustment of the bolt within the respective hole.

5. The footrest of claim 1, wherein each of the flanges includes a plurality of holes disposed in a vertical row for vertical adjustability of the footrest.

6. The footrest of claim 1 wherein the frame is constructed of a unitary piece of metal tubing, and the first and second mounting rods of the frame are substantially planar.

7. The footrest of claim 1, wherein the frame is vertically movable relative to the clamp.

* * * * *

UNITED STATES PATENT AND TRADEMARK OFFICE

CERTIFICATE OF CORRECTION

PATENT NO. : 6,648,417 B1
DATED : November 18, 2003
INVENTOR(S) : Gilbert et al.

It is certified that error appears in the above-identified patent and that said Letters Patent is hereby corrected as shown below:

Column 1,
Line 62, "To" should begin a new paragraph.

Column 3,
Line 31, "120.," should read -- 120, --.

Column 5,
Line 27, "comer" should read -- corner --.

Signed and Sealed this

Twenty-second Day of June, 2004

JON W. DUDAS
*Acting Director of the United States Patent and Trademark Office*